United States Patent [19]

Huster

[11] Patent Number: 4,531,018

[45] Date of Patent: Jul. 23, 1985

[54] HIGH VOLTAGE ELECTRICAL INSULATOR WITH ARCING HORN

[76] Inventor: Heinrich P. Huster, 1607 Cinnamon Rd., Ft. Wayne, Ind. 46825

[21] Appl. No.: 561,646

[22] Filed: Dec. 15, 1983

[51] Int. Cl.[3] ..... H01B 17/46

[52] U.S. Cl. ..... 174/140 R; 174/144; 361/137

[58] Field of Search ..... 174/140 R, 140 S, 140 CR, 174/141 R, 144; 361/132, 137, 138; 24/284; 248/230

[56] References Cited

U.S. PATENT DOCUMENTS

| | | | |
|---|---|---|---|
| 1,055,881 | 3/1913 | Creighton | 361/137 X |
| 1,448,773 | 3/1923 | Springer | 361/132 |
| 1,811,536 | 6/1931 | Carlisle | 174/141 R |
| 2,678,086 | 5/1954 | Mohr | 248/230 X |

FOREIGN PATENT DOCUMENTS

| | | | |
|---|---|---|---|
| 1200231 | 6/1959 | France | 361/137 |

*Primary Examiner*—Laramie E. Askin

*Attorney, Agent, or Firm*—George A. Gust

[57] ABSTRACT

A high voltage arcing horn device for safely dissipating electrical arcs caused by power surges in high voltage power lines, the device being provided with a first rigid electrode electrically connected to one of a pair of electrically isolated conductor terminals of an insulator, and a second rigid electrode electrically connected to the other of the conductor terminals, the electrodes including proximal portions fixedly clamped to the terminals and extending in predetermined spaced relationship adjacent the insulator and having distal end portions disposed in predetermined, parallel, spaced relationship one to the other.

13 Claims, 7 Drawing Figures

HIGH VOLTAGE ELECTRICAL INSULATOR WITH ARCING HORN

BACKGROUND OF THE INVENTION

1. Field of the Invention

The present invention relates to devices for dissipating high voltage electrical arcs which can occur around insulators used to support power transmission lines and in particular to such a device retro-fittable on conventional insulators used in the static line of such high voltage transmission lines.

2. Description of the Prior Art

A typical high voltage transmission line includes a plurality of substantially parallel conductors operating at high voltages such as for example 345 KV, 765 KV and the like. These transmission lines also include one or more static lines grounded at the terminal ends of the transmission line. Insulating of the static line can create a problem when the static line is subjected to a high voltage surge such as may occur when the line is struck by lightning or during significant power load changes, typically caused by transient conditions. These high voltage surges can cause arcing over or around the insulators supporting the static line on the transmission line towers. Such arcing can damage the insulators by causing them to shatter or by depositing a conductive film in the insulator surface, this film being produced by minute metallic particles carried by the electric arc.

One prior art method of eliminating such arcing has been to provide lightning arrestors or similar devices to protect each of the insulators. These devices can be relatively expensive thereby negating genuine cost savings by their installation. It is also difficult to ascertain when such prior art devices have been destroyed, thereby adding significant cost for inspection and testing.

There, therefore, exists a need for a reasonably inexpensive device which will dissipate electrical arcing around insulators when the lines which they are supporting are subjected to high voltage surges and to provide such a device which can be inexpensively retrofitted to existing "generic" insulators.

SUMMARY OF THE INVENTION

In general, the invention may include a high voltage arcing horn device for use with an electrical insulator having electrically isolated terminals mechanically coupled one to the other by the insulator body. The arcing horn device includes a first rigid electrode electrically connected to one of the insulator terminals and a second rigid electrode electrically connected to the other of the insulator terminals. Th electrodes include proximal portions extending in predetermined spaced relationship adjacent the insulator body and are provided with distal end portions which are disposed in predetermined parallel spaced relationship, one to the other.

In a specific embodiment of the invention, the insulator is a "dead end" insulator including an annular, disc-shaped insulator body having axially extending terminals fixedly embedded in its oppositely disposed surfaces. The arcing horn electrodes proximal portions are mechanically clamped to respective ones of the insulator terminals and extend radially outwardly therefrom. The distal end portions of the electrodes extend at substantially right angles to the proximal portions. A predetermined length of the distal end portions are disposed in parallel, circumferentially spaced relationship, one to the other, to establish an arcing gap of predetermined dimensions.

In another specific embodiment, the tips of the distal end portions are axially displaced a predetermined distance from the corner portions of the electrodes defined by the juncture of the proximal and distal portions. This prevents tip arcing and concentrated arc paths that can cause excessive burning or destruction of the electrodes.

It is therefore an object of the invention to provide a high voltage arcing horn device for use with a conventional insulator used in a high voltage transmission line.

Another object of the invention is to provide such an arcing horn apparatus which includes a pair of electrodes which can be retro-fittably attached to existing line insulators.

Still another object of the invention is to provide such an arcing horn device which provides an arc path of predetermined dimensions.

Another object of the invention is to provide such an arcing horn which is capable of repeated operation.

Another object of the invention is to provide such an apparatus whose condition can be readily verified from a distance.

Yet another object of the invention is to provide such device which can be easily installed on existing insulators without special tools and without modification or removal of the insulator.

The above-mentioned and other features and objects of this invention and the manner of attaining them will become more apparent and the invention itself will be best understood by reference to the following description of an embodiment of this invention taken in conjunction with the accompanying drawings.

DESCRIPTION OF A SPECIFIC EMBODIMENT

Figure 1:
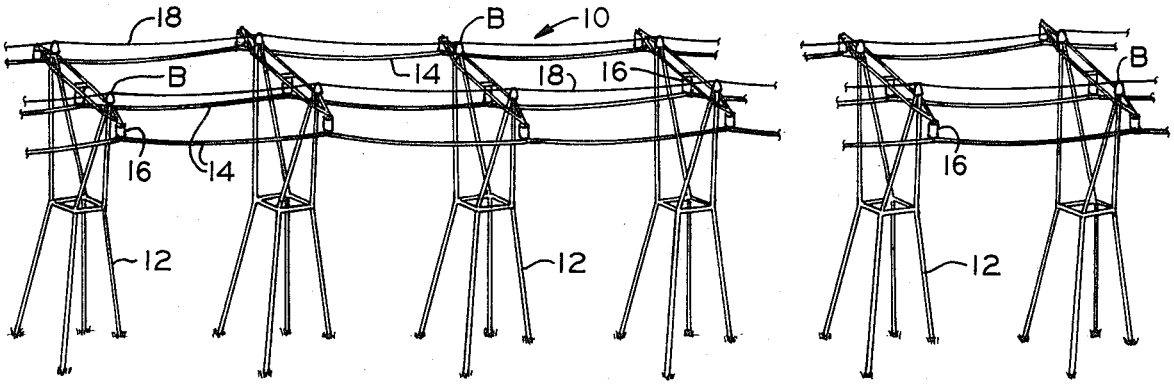
FIG. 1 is a diagrammatic perspective illustration showing a typical high voltage power transmission line and useful in explaining the application of the insulator arcing horn device of the present invention thereto.

Referring now to the drawings, there is shown diagrammatically in FIG. 1 a typical high voltage transmission line indicated generally at 10. Typically, the transmission line 10 comprises a multiplicity of tower structures 12 erected in spaced relationship, a plurality of high voltage conductors 14 suspended from the towers and electrically isolated therefrom by means of insulators as at 16, and a plurality of static or ground wire conductors as at 18. It is standard practice to provide the static wires as continuous conductors. Open circuits in the static lines can and will, during moments of high power surges as may occur when the lines are struck by lightning or during transient conditions, cause high voltages which could cause electrical arcing over and around the insulators "B". These arcs can cause the deposition of metal or other conductive material on the insulators, rendering them ineffective, or can result in destruction of the insulator due to the high temperature gradients occurring as a result of the arcing.

Figure 2:
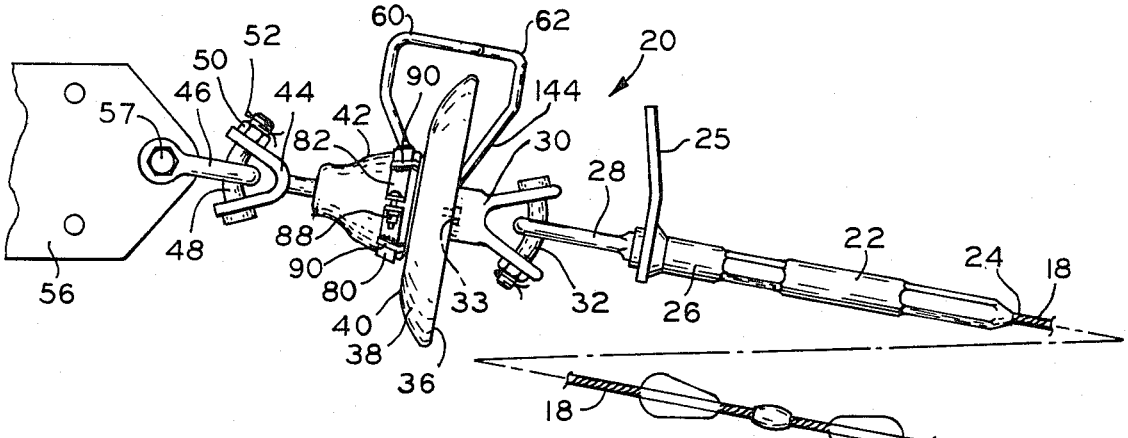
FIG. 2 is a fragmentary side plan view showing a typical installation of the arcing horn device of the present invention.

Referring now to FIG. 2, there is shown a typical insulated ground wire assembly indicated generally as 20. The static line 18, a typical heavy gauge electrical conductor, is provided with an elongated sleeve 22 which is crimped to the end 24 thereof. The sleeve 22 is typically provided with a jumper pad 25 which is press fitted to the end 26 thereof. End 26 is further formed with an eye portion 28.

A socket Y-clevis fitting 30 is pivotably coupled to eye 28 by means of an arced clevis pin, nut and cotter key assembly 32. The socket Y-clevis 30 is provided with a socket recess 33 dimensioned and shaped to couple to a conventional ball terminal 34 (not shown in FIG. 2) as described in more detail below.

The terminal 34 is in turn fixedly coupled to one surface 36 of a disc-shaped annular insulator body 38. The opposite surface 40 of insulator body 38 is fixedly coupled to a socket terminal 42. Terminal 42 is conventional and is described in more detail below.

A ball Y-clevis 44 is interlockingly received in a complementary recess 76 (not shown in FIG. 2) in the terminal 42, clevis 44 in turn being coupled to an eye shackle 46 via arced clevis pin 48, nut 50, and cotter key 52. The shackle 46 is coupled by means of a threaded fastener 57 to a conventional strain plate 56 of a conventional transmission line tower 12 (shown in FIG. 1).

Figure 3:
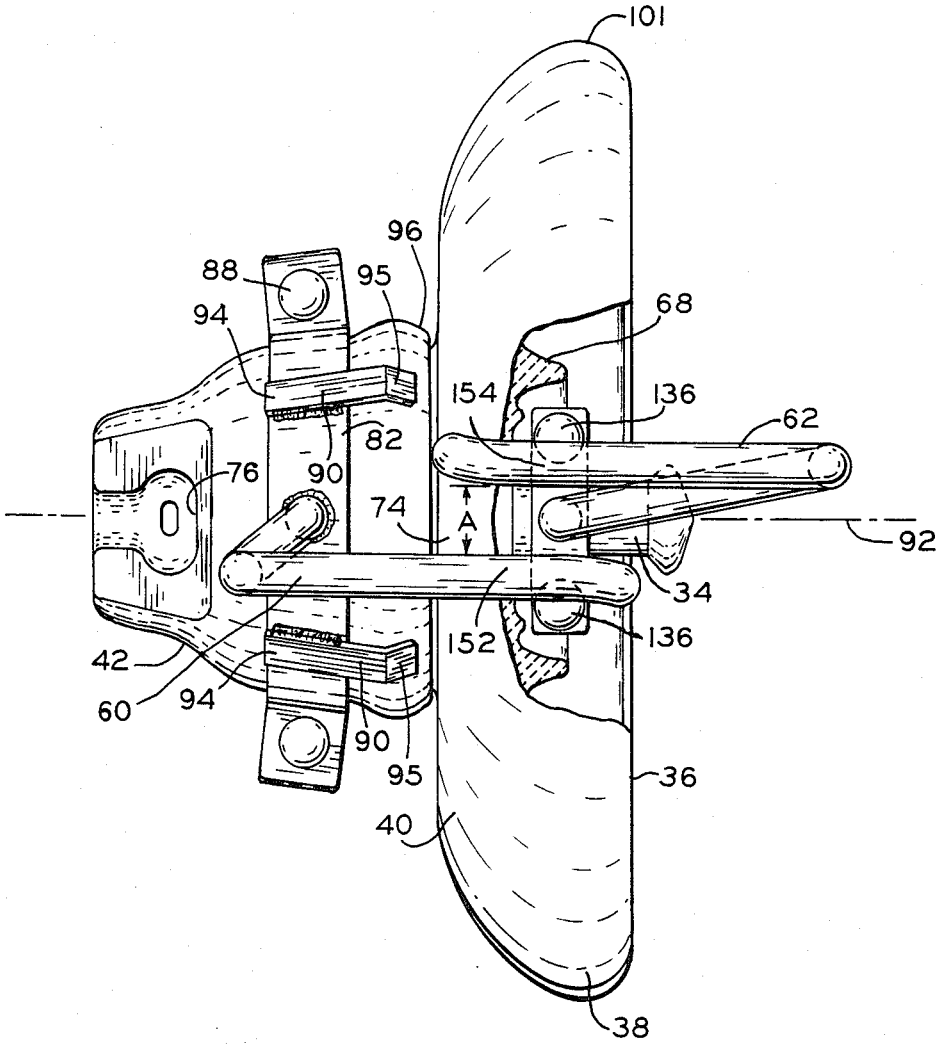
FIG. 3 is a side plan view, of the arcing horn device showing details of the installation thereof on a conventional line insulator.

To this end, a pair of arcing horns 60, 62, are provided. Referring in particular to FIG. 3, the construction of a conventional "dead end" insulator is shown in further detail. The insulator body 38 is typically manufactured of a durable ceramic having a smooth curved back surface 40 and a front surface 36 having a plurality of concentric ridges 68 formed therein to increase the insulating path, provide mechanical reinforcement and cooling. Ball terminal 34 is fixedly coupled to the insulator body 38 in a conventional manner as by casting of interlocking surfaces, threaded connection, or the like.

Similarly, an enlarged socket terminal 42 is fixedly coupled to the insulator body 38 surface 40 again by conventional techniques such as casting of interlocking surfaces, threading, or the like. It will be observed that the ball terminal 34 and socket terminal 42, while mechanically coupled, one to the other by the insulator body 38, are electrically isolated one from the other by an intermediate portion 74 of the insulator body 38 (FIG. 3 only).

Ball terminal 34 has a shape and dimension adapted to enable mechanically coupling it to a socket clevis 30, a socket terminal 42 of another insulator assembly or the like. Similarly, the socket terminal 42, is provided with a socket 76 complementary to the ball terminal 34 or a similar ball portion of a coupling element again enabling this electrode to be coupled directly to a tower, another insulator assembly, or the like. Such insulators are essentially "generic" in the power transmission arts and are currently installed in great numbers in transmission lines 10.

Since breaking the static line 18 into increments reduces the amount of induced current and the resultant power loss in the static line is significantly reduced thereby, selected ones of the jumper cables which would normally extend between adjacent ones of the jumper cable pads 25 are eliminated. It will be further apparent, however, that when the static line is thus broken, high voltage surges on line 18 which occur when the transmission line is struck by lightning, during certain transient conditions in the power load and the like, can cause arcing around the insulator body 38. Accordingly, it becomes necessary to provide a specific arcing path around the insulator body 38 which will dissipate the energy in the arc, obviate temperature gradients on the insulator body 38 which could cause it to shatter, and obviate the deposition of metallic or other conductive materials on the insulator body 38 which could alter its insulating characteristics and result in insulation failure.

Figure 4:
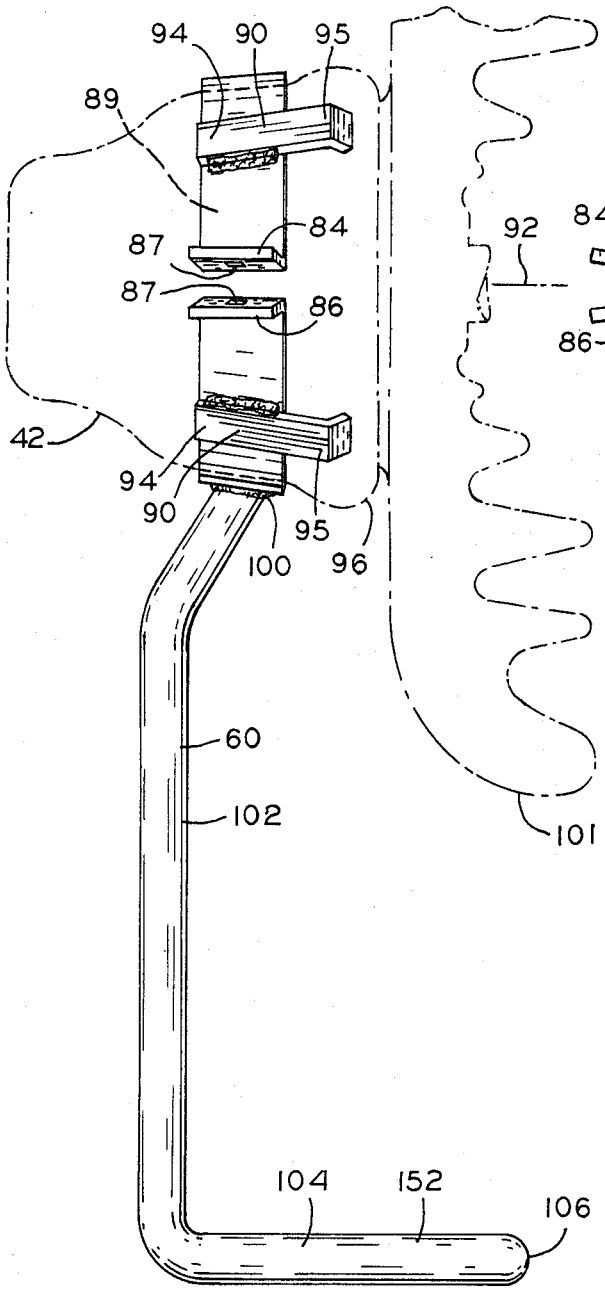
FIG. 4 is a side plan view of one of the electrodes of the apparatus adapted for installation on an insulator socket terminal.
Figure 5:
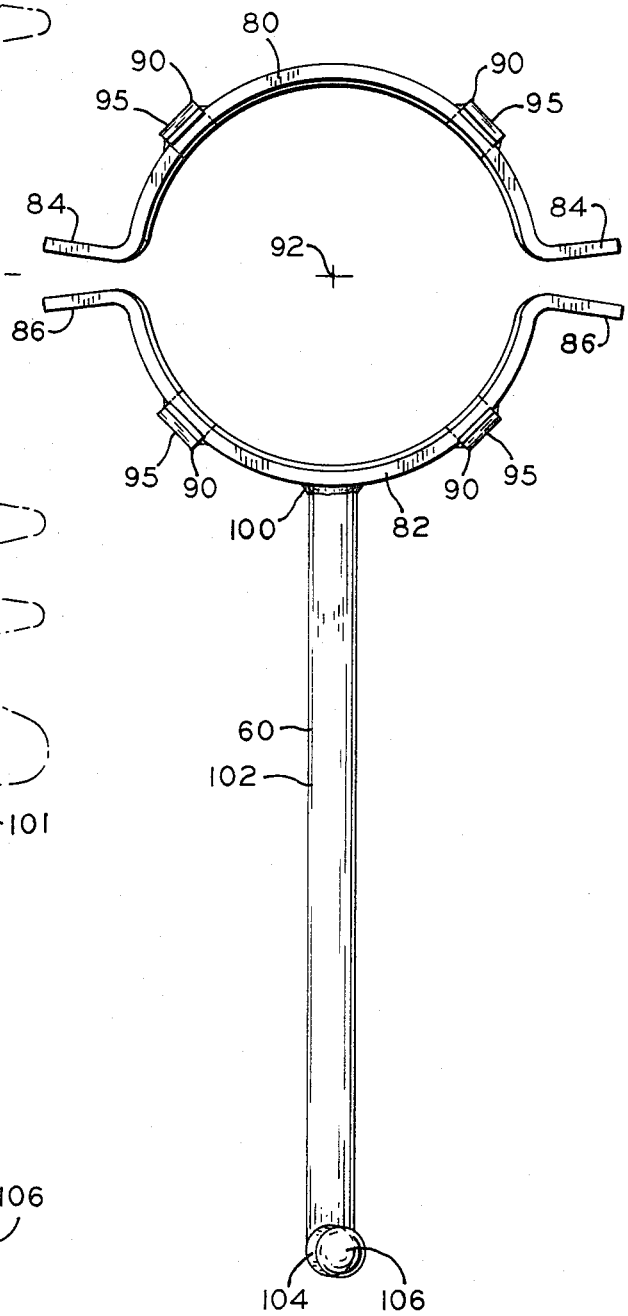
FIG. 5 is an end plan view of the electrode of FIG. 4.

Referring now in particular to FIGS. 4 and 5, a first electrode comprises a pair of arcuate clamp elements, 80, 82 each being of a semi-circular configuration and provided with radially outwardly extending flanges at their opposite ends as at 84 and 86. Through holes 87 (FIG. 4 only) are provided through the flanges 84, 86 in registered pairs and suitable threaded fasteners 88 (FIGS. 2 and 3 only) extend therethrough. It will be observed that the flanges 84, 86 are initially formed such that the opposed pairs of the flanges 84, 86 are angled away from each other from their proximal to their distal ends. The arc of the clamp elements 80, 82 is such that they will engage a predetermined portion 89 of the exterior of the socket terminal 42.

A plurality of locking fingers 90 are fixedly secured to the clamp elements 80, 82 in a symmetrical circumferentially spaced array. The fingers extend substantially axially with respect to the axis 92 of the insulator and in a direction towards the insulator body 38. The proximal ends 94 of the fingers 90 are fixedly secured to the clamp elements 80, 82 as by welding. Alternately, the fingers may be integrally formed as a part of elements 80, 82. The distal ends 95 are bent or otherwise formed inwardly such that the fingers, when the clamp elements 80, 82 are mounted around the socket terminal 42, will interlockingly engage the inwardly curving portion 96 of the terminal 42 surface. The threaded fasteners 88 are tightened until the flanges 84, 86 of the clamp elements 80, 82 are substantially parallel. By proper selection of the thickness and length of the elements 80, 82 and the angle thereof prior to tightening, the breakdown stage of the gap can be selectively determined. Tightening of the threaded fasteners 88 until the flange portions 84, 86 are parallel provides an effective calibration of the torque and correspondingly the proper tightness of clamping members 80, 82.

The arcing horn 60 is fixedly secured to the clamping member 82 by welding as at 100. The horn includes generally orthogonal leg portions 102, 104, the portion 102 extending radially outwardly with respect to axis 92 and portion 104 extending parallel thereto. The distal end 106 is hemispherical and the leg portion 104 is disposed a predetermined distance radially displaced from the outer periphery 101 of the insulator body 38.

Figure 6:
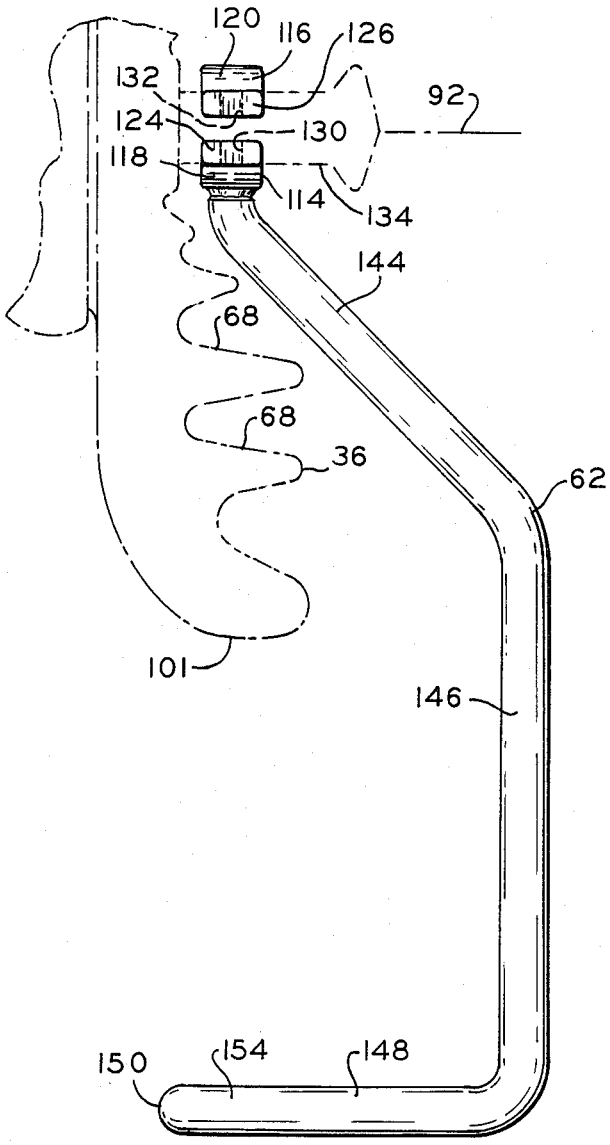
FIG. 6 is a side plan view of an electrode adapted for installation on an insulator ball terminal.
Figure 7:
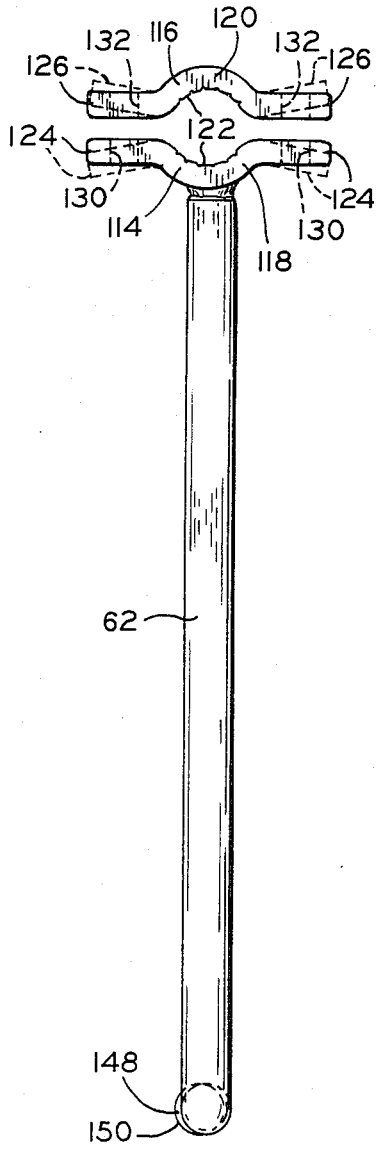
FIG. 7 is an end plan view of the electrode of FIG. 6.

A second electrode, best seen in FIGS. 6 and 7, includes a pair of clamp elements 114, 116. The elements 114, 116 are generally rectangular in plan and provided with arcuate center portions 118, 120 respectively. The inner surfaces 122 of arcuate portions 118, 120 are knurled. The distal ends 124, 126 are provided with registered pairs of through holes as at 130, 132 and suitable threaded fasteners 136 are received therethrough (FIG. 3 only). As in the case of the clamp elements 80, 82, the distal end portions 124, 126 may be formed such that they initially angle outwardly away from each other at a predetermined angle as shown in dotted lines in FIG. 7. Accordingly, when the threaded fasteners 136 are tightened to a proper torque, the end portions 124, 126 will be disposed substantially parallel, thereby again enabling proper tightening of the threaded fastener 136 without the use of special gauges, torque wrenches or the like. Also, as in the case of the inner surfaces of the arcuate portions 118, 120, the inner surfaces of the clamp elements 80, 82 may also be knurled.

The arcing horn 62 includes a first leg portion 144 which extends radially outwardly with respect to axis 92 and axially away from insulator surface 36. A second leg portion 146 of the arcing horn 62 extends orthogonally radially outwardly with respect to the axis 92, and a third leg portion 148 extends axially parallel to the axis 92 in a direction toward the insulator body 38. The angle of leg portion 144 provides proper spacing of the horn 62 from the insulator surface 36.

Referring to FIGS. 2 and 6, the leg portion 144 extends at an angle which provides adequate clearance between part 30 (FIG. 2) and the insulator body 38. The actual position of the angle of leg portion 144 is determined by the axial position of the clamp 118, 120 (FIG. 6) on the stud terminal 134. With this clamp 118, 120 so positioned, installation of part 30 on the ball end of stud 134 is facilitated.

The distal end 150 of arcing horn 62 is also hemispherical. It will now be observed that the distal end portions 152, 154 of the arcing horns 60, 62 hereinafter referred to as the arcing portions 152, 154, are disposed in overlapping, circumferentially, spaced apart relationship, one to the other. In a working embodiment, the length of these arcing portions overlap is about 1.0 inch. It will also be observed that the hemispherical ends 106 and 150 are longitudinally displaced a substantial distance from corners defined by the junction of leg portions 102, 104 and leg portions 146, 148 respectively. It will also be observed that the spacing between arcing portions 152, 154 can be varied and, accordingly, set at a predetermined gap "A" prior to tightening of clamps 80, 82 and 114, 116.

It should be noted that the tip portions 150 and 106 are preferably arced away from the opposite ones of the electrodes by a small amount. This reduces the possibility of tip arcing which can occur around the tips of the arcing horns 60, 62 as a result of the higher tip voltage gradients. This again reduces the possibility of concentrated arcs which could otherwise damage the arcing horns.

In operation the overlapping arc portions 152, 154 provide an arc gap of predetermined length and width. Accordingly, the dimension "A" (FIG. 3 only) will provide a gap which will "break down" at a predetermined voltage. The length of the portions 152, 154 assures that the actual arc will be of substantial and uniform width. This in turn assures that the energy being dissipated in the arc will not be highly concentrated, thereby obviating destruction as by burning off of the end portions of the arcing horns 60 and 62. It will of course be essential that the overlapping portions 152, 154 be disposed as nearly parallel as possible to insure uniformity of the arc. The overlapping length further provides a sufficient electrode mass such that the electrodes are able to absorb heat generated by the arc. The displacement of the hemispherical tips 106 and 150 from the corner junctions and small outward arc of the tips 106, 150 ensures that the arc will not walk or jump to these corner junctions (points of higher potential gradients) because of their shape, and thereby obviates burning off of the leg portions 104 and 148 at their corners during arcing conditions. The overlap further provides a sufficient mass of metal which can feed material as by vaporization during the arcing event. This dissipation of metal expends a substantial amount of energy in the arc. By providing sufficient overlap, this vaporization of the metal does not, however, significantly affect the gap or other dimensions of electrodes thereby enabling them to function repeatedly. The spacing of the arcing horns 60 and 62 from the faces of the insulator as well as the radial displacement of the gap "A" from the insulator body assures that deposition of vaporized metal on the insulator body 38 will be minimized, thereby obviating breakdown or reduced effectiveness of the insulator from such a conductive film. The distance between the gap "A" and insulator body 38 further ensures that the high temperature of the arc will not cause any thermal shock to the insulator body 38 which could destroy it.

The entire assembly is retro-fittable to existing insulators without modification. That is, the arcing horn device can be mounted on existing and installed insulators. This installation does not require any modification of the insulators, nor removal thereof. Installation can be performed in the field. The dimensioning and angling of the clamping members and the simple adjustment of the breakdown voltage of the gap by simply adjusting the dimension of the gap "A" ensures a rapid, accurate installation without special tools or training. The angled flanges assure proper tightening of the electrodes so that they will not move due to electromagnetic forces. The condition of the arcing horns can be readily observed from the ground, thereby eliminating the need for close inspection or the like as is typically required with "lightning" surge arresters and similar devices heretofore used. The electrodes can function repeatedly without destruction.

The arcing horn device is relatively inexpensive to manufacture even when a preferred material such as AISI TYPE 304 stainless steel is used.

In a working embodiment of the invention, the clamping elements are made of austenitic (type 18-8) stainless steel, the elements 80, 82 having a thickness of one-eighth inch and the element 118, 120 having a thickness of one-quarter inch. The electrodes are one-half inch in diameter and have a radial length of about twelve inches to provide a spacing between the gap portions 152, 154 and insulator body 38 of about four and one-half inches. The gap length is one inch and the gap opening "A" is about three-quarter inch. The top portions 106, 150 are spaced about three inches from the corners of the opposite electrode and are arced at a radius of about three inches from a point about one-half inch from the hemispherical ends or tips 106, 150.

While there have been described above the principles of this invention in connection with specific apparatus, it is to be clearly understood that this description is made only by way of example and not as a limitation to the scope of the invention.

What is claimed is:

1. In combination with a high voltage power transmission line insulator which includes a pair of terminals electrically isolated and mechanically coupled one to the other with an insulator body, an improved high voltage arcing horn device comprising a first elongated electrode fixedly secured at its proximal end to one of said insulator terminals, a second elongated electrode fixedly secured at its proximal end to the other of said terminals, said first and said second electrodes extending in predetermined, spaced relationship with respect to said insulator body and each including a distal end portion disposed in predetermined parallel spaced relationship to the distal end portion of the other of said distal end portion to thereby define an electrical arcing path therebetween of predetermined dimension.

2. The combination of claim 1 wherein said distal end portions of said first and second electrodes extend in longitudinally opposite directions.

3. The combination of claim 2 wherein said distal and said proximal end portions of said first and said second electrodes are substantially orthogonal and define corners at their junctures, the distal end portions terminating at respective tip portions, said tip portions of each of said electrodes being longitudinally spaced from the said corner of the other of said electrodes.

4. The combination of claim 3 wherein said electrodes have circular cross-sections, said tip portions being hemispherical, and said corners being arcuate.

5. The combination of claim 3 further including first clamping means fixedly secured to said first electrode proximal end for clamping said first electrode to one of said terminals.

6. The combination of claim 5 further including second clamping means fixedly secured to said second electrode proximal end for clamping said second electrode to the other of said terminals.

7. The combination of claim 1 further including first clamping means fixedly secured to said first electrode proximal end for clamping said first electrode to one of said terminals.

8. The combination of claim 7 further including second clamping means fixedly secured to said second electrode proximal end for clamping said second electrode to the other of said terminals.

9. The combination of claim 8 wherein each of said first and said second clamping means includes a pair of clamping elements having arcuate terminal engaging portions complementary to a predetermined portion of the corresponding one of said terminals.

10. The combination of claim 9 wherein each of said clamping elements includes a flange extending generally radially outwardly from each of the opposite ends of said arcuate terminal engaging portion, there being one said flange of each said clamping element disposed adjacent a said flange of the other of said clamping elements, said flanges being initially disposed at an angle outwardly and away from the said adjacent one of said flanges, and further including fastener means for adjustably coupling adjacent ones of said flanges, to thereby clamp said arcuate portions to a said terminal, adjacent ones of said flanges being rendered substantially parallel by the force of said fastener means when the clamping force of said clamping means is at a predetermined value.

11. The combination of claim 10 wherein said insulator is a line insulator with said insulator body formed as a generally annular, disc-shaped insulator body, said terminals extending axially outwardly therefrom, one of said terminals being a socket terminal having an inwardly curving portion in the outside surface thereof, said first electrode clamping means further including a plurality of axially extending finger elements including inwardly bent end portions axially interlockingly engaging said inwardly curving portion.

12. The combination of claim 11 wherein the other of said terminals is a ball terminal having a cylindrical base portion and an enlarged terminal end adapted to interlockingly engage a socket terminal, said second electrode clamping elements being rectangular plates having arcuate recesses formed centrally therein, said plates being clamped to said ball terminal contiguous said insulator body, said plates having an axially parallel dimension less than the distance between said insulator body and an adjacent socket terminal when the latter is coupled to said ball terminal.

13. The combination of claim 11 wherein said first electrode includes a proximal leg portion extending generally parallel to one surface of said insulator body, said second electrode including a proximal leg portion having a base leg extending radially outwardly from said other terminal at an angle.

* * * * *

UNITED STATES PATENT AND TRADEMARK OFFICE

CERTIFICATE OF CORRECTION

PATENT NO. : 4,531,018

DATED : July 23, 1985

INVENTOR(S) : Heinrich P. Huster

It is certified that error appears in the above-identified patent and that said Letters Patent is hereby corrected as shown below:

Column 1, line 53, change "Th" to --The---;
Column 3, line 36, insert --body--; after "insulator".
Column 3, line 37, delete "body".

Signed and Sealed this

*Twenty-eighth* Day of *January 1986*

[SEAL]

*Attest:*

DONALD J. QUIGG

*Attesting Officer*

*Commissioner of Patents and Trademarks*